United States Patent [19]

Staebler

[11] 4,202,928

[45] May 13, 1980

[54] UPDATEABLE OPTICAL STORAGE MEDIUM

[75] Inventor: David L. Staebler, Lawrenceville, N.J.

[73] Assignee: RCA Corporation, New York, N.Y.

[21] Appl. No.: 927,514

[22] Filed: Jul. 24, 1978

[51] Int. Cl.[2] ..... B32B 17/06; G01D 15/34

[52] U.S. Cl. ..... 428/446; 331/DIG. 1; 427/39; 428/428; 428/432; 357/2; 252/600; 365/106; 365/129

[58] Field of Search ..... 427/34, 423, 38, 39; 357/2; 346/76 L; 428/432, 428, 446; 331/DIG. 1

[56] References Cited

U.S. PATENT DOCUMENTS

| | | | |
|---|---|---|---|
| 3,485,666 | 12/1969 | Sterling | 427/39 |
| 3,655,438 | 4/1972 | Sterling | 427/39 |
| 3,716,844 | 2/1973 | Brodsky | 346/76 L |

OTHER PUBLICATIONS

Chittick; R. C., "The Prep. and Properties of Amorphous Si," *J. Electrochem. Soc.: Solid State Science,* Jan. 1969, pp. 77–81.

*Primary Examiner*—Ellis P. Robinson
*Attorney, Agent, or Firm*—B. E. Morris; H. Christoffersen; W. J. Burke

[57] ABSTRACT

Amorphous silicon layers deposited on a suitable substrate in a glow discharge of silane or other silicon containing compounds are sensitive optical storage media.

12 Claims, 4 Drawing Figures

UPDATEABLE OPTICAL STORAGE MEDIUM

BACKGROUND OF THE INVENTION

There is a continuing need for archival storage of information in condensed form for economy pf storage. In the past this need has been satisfied by microfilm and microfiche techniques. Information, such as printed or graphic matter, is stored on photographic film as microimages. The film is then developed, fixing the stored information such that is cannot be subsequently altered. There has arisen a need for a capability in archival storage for subsequent updating of the stored information. Photographic film is not suitable for such applications since the capability for updating the stored information ends with development.

Ohta et al, U.S. Pat. No. 3,971,874 issued July 27, 1976, teach an optical information storage material having a transparent substrate, a $TeO_x$ layer or a mixture of tellurium and vanadium or lead oxides deposited on the substrate with a protective layer thereover. The $TeO_x$ layer alone, or with vanadium or lead added, is light sensitive, darkening on exposure to light or upon contact heating. With subsequent exposure to light or heat the layer can be darkened in areas not previously darkened. The addition of vanadium oxide to the $TeO_x$ layer improves the erasure properties of the layer. This storage medium has the disadvantages that a temperature of over 700° C. is required for evaporation of the light sensitive layer and that tellurium is a highly toxic material.

Thus it would be desirable to have a light sensitive layer in which information can be recorded and in which additional information can be subsequently recorded, which is non-toxic, and which does not require high temperatures in the preparation of the layer.

SUMMARY OF THE INVENTION

An updateable optical storage medium comprises a transparent substrate and an amorphous silicon layer overlying said transparent substrate. The amorphous silicon layer darkens upon exposure to a light beam of sufficient intensity, permitting the storage of information in the layer. The sensitivity of the amorphous silicon layer is not destroyed during or after the recording process for darkening levels less than the saturation value. Thus, additional information can be added at a later date.

DETAILED DESCRIPTION OF THE INVENTION

Figure 1:
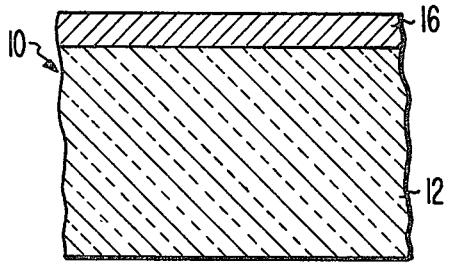
FIGS. 1, 2, and 3 are cross-sectional views of several embodiments of the optical storage medium of the invention.

Referring to the drawings, FIG. 1 shows a cross-sectional view of an optical storage medium 10 of the invention which includes a transparent substrate 12 and an amorphous silicon layer 16 overlying said transparent substrate 12.

The substrate is an optically transparent material such as glass or plastic of sufficient thickness to support the remainder of the structure.

The amorphous silicon layer is deposited on the substrate from a glow discharge generally according to the teachings of Carlson, U.S. Pat. No. 4,064,521 issued December 20, 1977 and incorporated herein by reference. The glow discharge atmosphere includes a silicon containing compound such as $SiH_4$, $SiH_2Cl_2$, $SiHCl_3$, $SiCl_4$, $SiH_3Br$, $SiH_2Br_2$ and the like. However, the substrate is, in contrast to the teaching of Carlson, kept at a temperature below 200° C. during deposition.

The preferred method of deposition is to deposit the amorphous silicon layer 16 from a direct current glow discharge. Alternatively, the amorphous silicon layer 16 of the optical storage medium 10 can be deposited from a radio frequency discharge.

The thickness of the amorphous silicon layer deposited from the glow discharge can typically range from about 500 angstroms up to about 5000 angstroms. If the layer is too thin, the decrease in transmission of the layer after exposure to a light source is inadequate to provide sufficient contrast between colored and uncolored portions of the layer. Similarly, if the layer is too thick, the background absorption of unexposed portions of the layer will prevent the buildup of adequate contrast between exposed and unexposed portions of the layer.

The amorphous silicon layer can be doped with an n-type dopant such as phosphorous or a p-type dopant such as boron. Typically, one percent of $PH_3$ or $B_2H_6$ by volume is added to the primary silicon-containing gas to dope the amorphous silicon layer.

Figure 2:
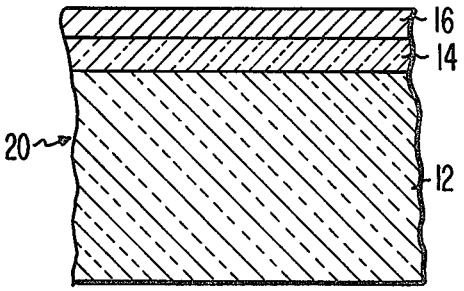

FIG. 2 shows a cross-sectional view of an optical storage medium 20 of the invention which includes a transparent substrate 12, a transparent electrically conducting layer 14 overlying the transparent substrate 12 and an amorphous silicon layer 16 overlying the transparent conducting layer 14.

A transparent conducting layer is required as a cathode if a direct current cathodic discharge is used to deposit the amorphous silicon film. The transparent electrically conducting layer is a material such as indium tin oxide or tin oxide deposited on the substrate by evaporation, spraying or other suitable methods. This layer is typically about 500 to 3,500 angstroms thick. If a transparent conducting layer is of sufficient thickness to support the remainder of the structure, an additional substrate layer is not needed.

Figure 3:
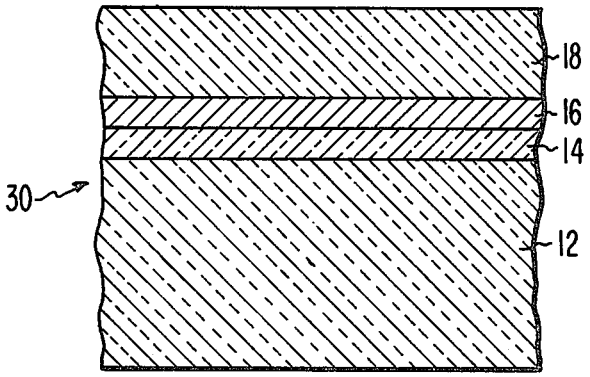

FIG. 3 shows a cross-sectional view of an optical storage medium 30 of the invention which includes a transparent substrate 12, a transparent electrically conducting layer 14 overlying said substrate, an amorphous silicon layer 16 overlying said transparent electrically conducting layer 14 and a protective overcoat layer 18 overlying said amorphous silicon layer. The amorphous silicon layer is insensitive to ambient conditions and is not toxic. Thus a protective overcoat layer is not required. However, if such a protective layer is desired for protection from dust, abrasion, etc. a layer of an optically transparent material which will adhere to and not chemically attack the amorphous silicon can be used. Useful materials for such a protective layer include inorganic materials such as $SiO_2$ and organic materials such as sucrose benzoate or poly(methylmethacrylate).

Preferably, the protective overcoat layer is deposited by evaporation or spinning. The thickness of this layer need only be sufficient to provide a barrier to direct contact or abrsion of the amorphous silicon film, typically more than 2000 angstroms.

Figure 4:
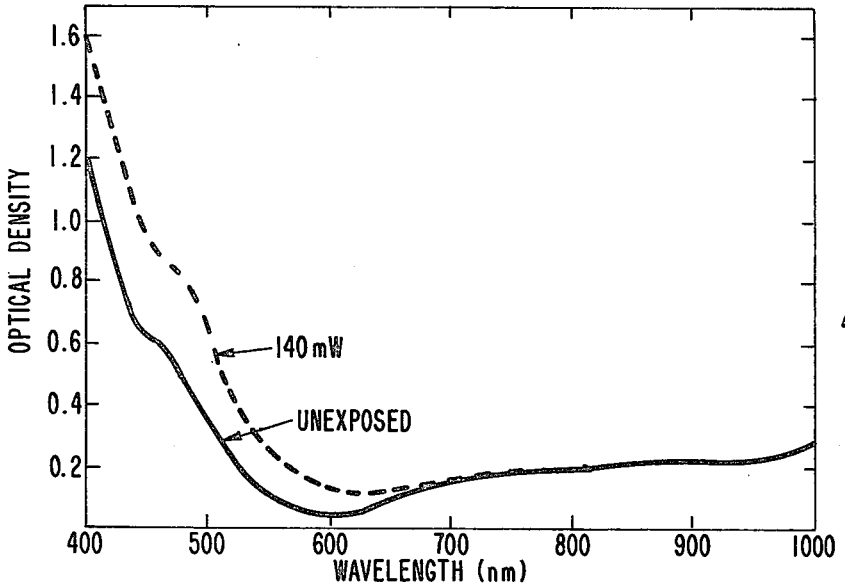
FIG. 4 is a graph comparing the optical density of an undoped amorphous silicon film before and after exposure to a focussed laser beam.

FIG. 4 is a graph showing the optical absorption spectrum of an undoped amorphous silicon layer before and after exposure to a raster scanned 140 milliwatt argon ion laser beam focussed to a 90 micron ($\mu$) diameter spot. The absorption edge of the amorphous silicon layer shifts to longer wavelengths with exposure resulting in an increase in the optical absorption of the layer. This increase in optical absorption is irreversible.

The magnitude of the decrease in transmission and the sensitivity depend upon the dopant used. A boron doped layer has a larger decrease in transmission and higher sensitivity than an undoped layer. A phosphorous doped layer has a lower sensitivity than an undoped layer and about the same decrease in transmission as an undoped layer.

The maximum contrast ratio of the transmission of an uncolored to a colored layer for a boron doped layer is about 4 to 5. For a phosphorous or undoped amorphous silicon layer, the maximum contrast ratio is about 2.5 to 3.5.

The increase in the optical absorption of an amorphous silicon layer prepared according to the invention is caused by the heating of the layer by energy absorbed from the light beam. The thermal activation energy for this process is about one electron-volt. Thus the coloration rate will depend upon the temperature to which a region of the layer to be colored is raised which depends upon the power of the incident light beam, the amount of absorption, the dimensions of the spot to which the beam is focussed and the exposure time. Typically, for a 2000 angstrom thick boron-doped armorphous silicon layer, an exposure time of 500 seconds is required to obtain a contrast ratio of two using a 488 nm light beam with a power of 34 milliwatts focussed to a 100$\mu$ diameter spot. For a 116 milliwatt beam, only 0.001 second is required to obtain a contrast ratio of two.

Information can be stored in the storage medium of the invention by the darkening of the amorphous silicon layer. The darkening of the layer, either in a single exposure or in sequential exposures, can proceed up to a saturation value where further exposure to light does not produce a further darkening of the layer. The darkening of the amorphous silicon layer is irreversible. Thus the optical storage medium of the invention is particularly suited for archival storage since information, once stored, cannot be erased. The storage medium can, however, be updated by the subsequent storage of additional information in the amorphous silicon layer.

I claim:

1. In an optical storage medium comprising a transparent substrate and a light sensitive layer overlying said substrate, the improvement wherein the light sensitive layer is a layer of amorphous silicon between about 500 angstroms and 5000 angstroms thick which is deposited onto said substrate from a glow discharge and which contains information stored in the form of a pattern of regions with increased optical absorption.

2. An optical storage medium according to claim 1 wherein said substrate is a transparent plastic.

3. An optical storage medium according to claim 1 wherein said glow discharge is maintained in a gas atmosphere which includes a silicon-containing compound selected from the group consisting of $SiH_4$, $SiHCl_3$, $SiH_2Cl_2$, $SiH_3Cl$, $SiCl_4$, $SiH_3Br$, and $SiH_2Br_2$.

4. An optical storage medium according to claim 1 wherein said amorphous silicon layer is doped with a p-type conductivity modifier.

5. An optical storage medium according to claim 4 wherein said p-type conductivity modifier is boron.

6. An optical storage medium according to claim 1 wherein said amorphous silicon layer is doped with a n-type conductivity modifier.

7. An optical storage medium according to claim 6 wherein said n-type conductivity modifier is phosphorous.

8. An optical storage medium according to claim 1 wherein the temperature of said substrate during deposition of the amorphous silicon layer is less than 200° C.

9. An optical storage medium according to claim 1 wherein said glow discharge is a radio frequency glow discharge.

10. An optical storage medium according to claim 1 wherein said transparent substrate includes an optically transparent, electrically conducting layer contiguous to said amorphous silicon layer.

11. An optical storage medium according to claim 1 wherein said glow discharge is a direct current glow discharge.

12. An optical storage medium according to claim 1 wherein a transparent, chemically inert protective overcoat layer overlays and adheres to said light sensitive layer.

* * * * *